US010037728B2

(12) United States Patent
Guo et al.

(10) Patent No.: US 10,037,728 B2
(45) **Date of Patent: *Jul. 31, 2018**

(54) DISPLAY DRIVING METHOD, DISPLAY DRIVING DEVICE AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 72 days.

This patent is subject to a terminal disclaimer.

(21) Appl. No.: 15/083,934

(22) Filed: Mar. 29, 2016

(65) Prior Publication Data

US 2017/0004756 A1 Jan. 5, 2017

(30) Foreign Application Priority Data

Jun. 30, 2015 (CN) ..... 2015 1 0375408

(51) Int. Cl.
*G09G 3/20* (2006.01)
*G09G 3/00* (2006.01)

(52) U.S. Cl.
CPC ..... *G09G 3/2074* (2013.01); *G09G 3/003* (2013.01); *G09G 3/2003* (2013.01); *G09G 2300/0452* (2013.01); *G09G 2340/0457* (2013.01)

(58) Field of Classification Search
CPC .... G09G 3/003; G09G 3/2003; G09G 3/2074; G09G 3/32–3/3291;
(Continued)

(56) References Cited

U.S. PATENT DOCUMENTS

2002/0070909 A1* 6/2002 Asano ..... G09G 3/3233 345/76
2010/0013848 A1* 1/2010 Hekstra ..... G09G 3/20 345/589
(Continued)

FOREIGN PATENT DOCUMENTS

CN 103886808 A 6/2014
CN 104680966 A 6/2015

OTHER PUBLICATIONS

Office Action in Chinese Application No. 201510375408.1 dated Mar. 2, 2017, with English translation. 11 pages.

*Primary Examiner* — Nathan Danielsen
(74) *Attorney, Agent, or Firm* — Womble Bond Dickinson (US) LLP

(57) ABSTRACT

The embodiments of the present invention relate to the field of display technologies, and provide a display driving method, a display driving device and a display device for improving the display effect of a display device with a given area of the subpixels. The method comprises: receiving an image signal; converting the image signal into a virtual pixel array and determining a color component corresponding to a color of each subpixel in each virtual pixel of the virtual pixel array; arranging a sampling region for each subpixel on the pixel array of the display device; determining a grey scale signal for the subpixel corresponding to the sampling region depending on the color component corresponding to the color of the subpixel in each virtual pixel covered by the
(Continued)

sampling region; and displaying the image signal depending on the grey scale signal for the subpixel.

15 Claims, 12 Drawing Sheets

(58) Field of Classification Search
CPC ..... G09G 3/36–3/3696; G09G 5/02; G09G 2300/0439; G09G 2300/0452; G09G 2320/0271; G09G 2320/0276; G09G 2340/04; G09G 2340/0457; G09G 2340/10; H01L 27/3211; H01L 27/3213; H01L 27/3216; H01L 27/3218; G02F 2001/134345; G06T 3/40–3/4092
See application file for complete search history.

(56) References Cited

U.S. PATENT DOCUMENTS

| | | | | |
|---|---|---|---|---|
| 2011/0140999 | A1 | 6/2011 | Beland et al. | |
| 2012/0086708 | A1* | 4/2012 | Lin ..... | G09G 3/003 345/419 |
| 2012/0148209 | A1 | 6/2012 | Gunji | |
| 2013/0241946 | A1 | 9/2013 | Jeong et al. | |

* cited by examiner

| | C1 S1 | C2 S2 | C3 S3 | C4 S4 | C5 S5 | C6 S6 | C7 S7 | C8 S8 | C9 S9 | C10 S10 | C11 S11 | C12 S12 | C13 S13 | C14 S14 | C15 S15 |
|---|---|---|---|---|---|---|---|---|---|---|---|---|---|---|---|
| L1 | R1 | G2 | B3 | R4 | G1 | B2 | R3 | G4 | B1 | R2 | G3 | B4 | R1 | G2 | B3 |
| L2 | B1 | R2 | G3 | B4 | R1 | G2 | B3 | R4 | G1 | B2 | R3 | G4 | B1 | R2 | G3 |
| L3 | R4 | G1 | B2 | R3 | G4 | B1 | R2 | G3 | B4 | R1 | G2 | B3 | R4 | G1 | B2 |
| L4 | B4 | R1 | G2 | B3 | R4 | G1 | B2 | R3 | G4 | B1 | R2 | G3 | B4 | R1 | G2 |
| L5 | R3 | G4 | B1 | R2 | G3 | B4 | R1 | G2 | B3 | R4 | G1 | B2 | R3 | G4 | B1 |
| L6 | B3 | R4 | G1 | B2 | R3 | G4 | B1 | R2 | G3 | B4 | R1 | G2 | B3 | R4 | G1 |
| L7 | R2 | G3 | B4 | R1 | G2 | B3 | R4 | G1 | B2 | R3 | G4 | B1 | R2 | G3 | B4 |
| L8 | B2 | R3 | G4 | B1 | R2 | G3 | B4 | R1 | G2 | B3 | R4 | G1 | B2 | R3 | G4 |

Fig. 6

DISPLAY DRIVING METHOD, DISPLAY DRIVING DEVICE AND DISPLAY DEVICE

RELATED APPLICATIONS

The present application claims the benefit of Chinese Patent Application No. 201510375408.1, filed on Jun. 30, 2015, the entire disclosure of which is incorporated herein by reference.

FIELD

The present invention relates to the field of display technologies, and in particular to a display driving method, a display driving device and a display device.

BACKGROUND ART

At present, displays have been widely applied in various electronic devices, such as a mobile phone, a personal digital assistant (PDA for short), a digital camera, a computer screen or a notebook computer screen. Besides, three dimensional (3D for short) image display has gradually become one of the important features of various electronic devices.

3D image display technology creates parallax of left and right eyes by resorting to artificial measures such that left and right eyes receive two different images respectively. Finally, the brain processes the two images obtained by right and left eyes and produces a sensation of observing a real three dimensional object. Like in a conventional display device, each pixel in a 3D display device displays a color by a plurality of subpixels through light mixing. For example, each pixel is composed of a red subpixel, a green subpixel and a blue subpixel. When the pixel performs display, the red subpixel, the green subpixel and the blue subpixel display a red grey scale, a green grey scale and a blue grey scale respectively such that human eyes see various different colors. However, with an increase in the sensational requirement of the display screen by a user, the sampling rate (which is quantified by PPI (pixels per inch, indicating a number of pixels per inch)) of images by a display device becomes higher and higher, and the area of the subpixels becomes smaller and smaller. Right now, the manufacture process for subpixels has reached a limit. Therefore, how to improve the display effect of a display device with a given area of subpixels has become an urgent problem to be solved by those skilled in the art.

SUMMARY

The embodiments of the present invention provide a display driving method, a display driving device and a display device for improving the display effect of a display device with a given area of the subpixels.

To achieve the above goal, the embodiments of the present invention adopt technical solutions as follows.

In a first aspect, a display driving method is provided for driving a 3D display device. The 3D display device comprises a pixel array and a grating array, wherein odd-number lines of the pixel array comprise a subpixel of a first color, a subpixel of a second color and a subpixel of a third color arranged in a sequential and cyclic manner, and even-number lines of the pixel array comprise a subpixel of the third color, a subpixel of the first color and a subpixel of the second color arranged in a sequential and cyclic manner, subpixels in the even-number lines and subpixels in the odd-number lines being offset from each other.

The method comprises:

receiving an image signal;

converting the image signal into a virtual pixel array and determining a color component corresponding to a color of each subpixel in each virtual pixel of the virtual pixel array;

arranging a sampling region for each subpixel on the pixel array of the display device;

determining a grey scale signal for the subpixel corresponding to the sampling region depending on the color component corresponding to the color of the subpixel in each virtual pixel covered by the sampling region; and displaying the image signal depending on the grey scale signal for the subpixel.

In a specific embodiment, the step of determining a grey scale signal for the subpixel corresponding to the sampling region depending on the color component corresponding to the color of the subpixel in each virtual pixel covered by the sampling region comprises:

acquiring an area of the sampling region;

acquiring an overlapping area of the sampling region and each virtual pixel covered by the sampling region, and deriving a ratio of the overlapping area to the area of the sampling region to obtain a weight factor for each virtual pixel covered thereby; and determining a grey scale signal for the subpixel corresponding to the sampling region by performing a weighted summation with the obtained weight factor on the color component corresponding to the color of the subpixel in each virtual pixel covered thereby.

In a specific embodiment, the step of arranging a sampling region for each subpixel on the pixel array of the display device comprises:

dividing each line of subpixels in the pixel array into a first view subpixel, a second view subpixel, a third view subpixel and a fourth view subpixel arranged in a sequential and cyclic manner, wherein for subpixels in the nth and the (n+1)th lines, when n is divided by 8 and the remainder is 1, the first subpixel in this line is the first view subpixel, when n is divided by 8 and the remainder is 3, the first subpixel in this line is the fourth view subpixel, when n is divided by 8 and the remainder is 5, the first subpixel in this line is the third view subpixel, and when n is divided by 8 and the remainder is 7, the first subpixel in this line is the second view subpixel, and wherein n is an odd-number;

determining midpoints in links of centers for all adjacent like-subpixels of each subpixel, wherein the adjacent like-subpixels of a subpixel refer to subpixels, which are of the same color and belong to the same view with the subpixel, and the pixel lines thereof are adjacent or separated by one line with the pixel line of the subpixel; and arranging a sampling region corresponding to the subpixel based on the midpoints, vertexes of the sampling region falling at the midpoints.

In a specific embodiment, the virtual pixels in the virtual pixel array are in a shape of square. The side of the square is the same as the height of the subpixel. Each line of the virtual pixel array is aligned with a corresponding line of the pixel array.

In a specific embodiment, the first color, the second color and the third color are respectively red, green and blue.

In a second aspect, a display driving device is provided for driving a 3D display device. The 3D display device comprises a pixel array and a grating array, wherein odd-number lines of the pixel array comprise a subpixel of a first color, a subpixel of a second color and a subpixel of a third color arranged in a sequential and cyclic manner, and even-number lines of the pixel array comprise a subpixel of the third color, a subpixel of the first color and a subpixel of the second color arranged in a sequential and cyclic manner, subpixels in the even-number lines and subpixels in the odd-number lines being offset from each other.

The display driving device comprises:

a receiving unit configured for receiving an image signal;

a converting unit configured for converting the image signal into a virtual pixel array and determining a color component corresponding to a color of each subpixel in each virtual pixel of the virtual pixel array;

a sampling unit configured for arranging a sampling region for each subpixel on the pixel array of the display device;

a processing unit configured for determining a grey scale signal for the subpixel corresponding to the sampling region depending on the color component corresponding to a color of the subpixel in each virtual pixel covered by the sampling region; and a driving unit for displaying the image signal depending on the grey scale signal for the subpixel.

In a specific embodiment, the processing unit comprises:

an acquiring subunit configured for acquiring an area of the sampling region, wherein the acquiring subunit is further configured for acquiring an overlapping area of the sampling region and each virtual pixel covered by the sampling region, and deriving a ratio of the overlapping area to the area of the sampling region to obtain a weight factor for each virtual pixel covered thereby; and a processing subunit configured for determining a grey scale signal for the subpixel corresponding to the sampling region by performing a weighted summation with the obtained weight factor on the color component corresponding to the color of the subpixel in each virtual pixel covered thereby.

In a specific embodiment, the sampling unit comprises:

a dividing subunit configured for dividing each line of subpixels in the pixel array into a first view subpixel, a second view subpixel, a third view subpixel and a fourth view subpixel arranged in a sequential and cyclic manner, wherein for subpixels in the nth and the (n+1)th lines, when n is divided by 8 and the remainder is 1, the first subpixel in this line is the first view subpixel, when n is divided by 8 and the remainder is 3, the first subpixel in this line is the fourth view subpixel, when n is divided by 8 and the remainder is 5, the first subpixel in this line is the third view subpixel, and when n is divided by 8 and the remainder is 7, the first subpixel in this line is the second view subpixel, and wherein n is an odd-number;

a determining subunit configured for determining midpoints in links of centers for all adjacent like-subpixels of each subpixel, wherein the adjacent like-subpixels of a subpixel refer to subpixels, which are of the same color and belong to the same view with the subpixel, and the pixel lines thereof are adjacent or separated by one line with the pixel line of the subpixel; and an arranging subunit configured for arranging a sampling region corresponding to the subpixel based on the midpoints, vertexes of the sampling region falling at the midpoints.

In a specific embodiment, the virtual pixels in the virtual pixel array are in a shape of square. The side of the square is the same as the height of the subpixel. Each line of the virtual pixel array is aligned with a corresponding line of the pixel array.

In a specific embodiment, the first color, the second color and the third color are respectively red, green and blue.

In a third aspect, a display device is provided. The display device comprises a display driving device described in any one of the second aspect.

According to the display driving method, the display driving device and the display device provided in embodiments of the present invention, upon reception of an image signal, the image signal is first converted into a virtual pixel array and a color component corresponding to a color of each subpixel in each virtual pixel of the virtual pixel array is determined; then a sampling region is arranged for each subpixel on the pixel array of the display device and a grey scale signal for the subpixel corresponding to the sampling region is determined depending on the color component corresponding to the color of the subpixel in each virtual pixel covered by the sampling region; and finally, the image signal is displayed depending on the grey scale signal for the subpixel. Since the grey scale for each subpixel is determined based on the color components of the virtual pixels covered by the sampling region, the color components of a plurality of virtual pixels can be displayed with one subpixel in the pixel array according to embodiments of the present invention. That is to say, subpixels in the pixel array can be "shared" to achieve a resolution higher than the actual resolution in visual effects. Therefore, embodiments of the present invention can improve display effects of the display device with a given size of the subpixels.

BRIEF DESCRIPTION OF DRAWINGS

In order to explain the technical solutions according to embodiments of the present invention more clearly, the figures to be used in the embodiments or the prior art shall be briefly introduced as follows. Apparently, the figures in the following description are only some embodiments of the present invention. For those having ordinary skills in the art, on the premise of making no inventive efforts, other figures can be obtained based on these ones.

FIG. 6 is a schematic structural view of the pixel array as shown in FIG. 1 which is divided into four view subpixels provided according to an embodiment of the present invention;

DETAILED DESCRIPTION OF EMBODIMENTS

The technical solutions in the embodiments of the present invention shall be described as follows in a clear and complete manner with reference to the drawings in the embodiments of the present invention. Apparently, the embodiments described here are only a part of the embodiments of the present invention, rather than all of them. Based on the embodiments of the present invention, all other embodiments obtained by those having ordinary skills in the art without inventive efforts, shall fall within the protection scope of the present invention.

It should be noted that in the embodiments of the present invention, lines and columns are relative concepts. In the description of the embodiments of the present invention, lines go in a horizontal direction, i.e., a line direction in the present application, and columns go in a vertical direction, i.e., a column direction in the present application. However, since pixels are arranged in a form of matrix, when observed from different directions, lines and columns can interchange, and hence the line direction and the column direction can also interchange.

A display driving method is provided in an embodiment of the present invention. The display driving method is used for driving a 3D display device. The 3D display device comprises a pixel array and a grating array, wherein odd-number lines of the pixel array comprise a subpixel of a first color, a subpixel of a second color and a subpixel of a third color arranged in a sequential and cyclic manner, and even-number lines of the pixel array comprise a subpixel of the third color, a subpixel of the first color and a subpixel of the second color arranged in a sequential and cyclic manner, subpixels in the even-number lines and subpixels in the odd-number lines being offset from each other.

Figure 1:
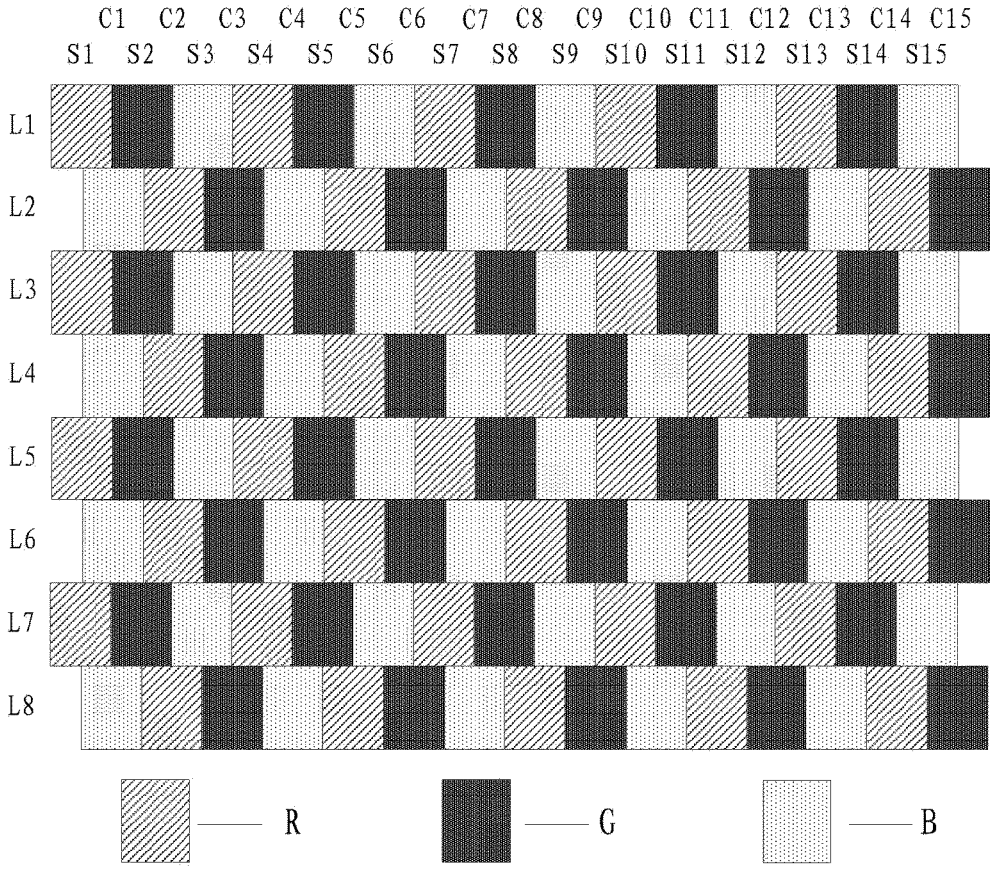
FIG. 1 is a schematic structural view of a pixel array provided according to an embodiment of the present invention.

Specifically, as shown in FIG. 1, the subpixel of the first color, the subpixel of the second color and the subpixel of the third color are respectively a red subpixel (R), a green subpixel (G), and a blue subpixel (B). Subpixels in the odd-number lines of the pixel array form 15 columns of subpixels (S1-S15), subpixels in the even-number lines of the pixel array form 15 columns of subpixels (C1-C15), and the pixel array comprises 8 lines (L1-L8) of subpixels. In the first line (L1) of subpixels of the pixel array, the $1^{st}$, $4^{th}$, $7^{th}$, $10^{th}$ and $13^{th}$ subpixels (L1S1, L1S4, L1S7, L1S10 and L1S13) are red subpixels; the $2^{nd}$, $5^{th}$, $8^{th}$, $11^{th}$ and $14^{th}$ subpixels (L1S2, L1S5, L1S8, L1S11 and L1S14) are green subpixels; and the $3^{rd}$, $6^{th}$, $9^{th}$, $12^{th}$ and $15^{th}$ subpixels (L1S3, L1S6, L1S9, L1S12 and L1S15) are blue subpixels. In the second line (L2) of subpixels of the pixel array, the $1^{st}$, $4^{th}$, $7^{th}$, $10^{th}$ and $13^{th}$ subpixels (L2S1, L2S4, L2S7, L2S10 and L2S13) are blue subpixels; the $2^{nd}$, $5^{th}$, $8^{th}$, $11^{th}$ and $14^{th}$ subpixels (L2S2, L2S5, L2S8, L2S11 and L2S14) are red subpixels; and the $3^{rd}$, $6^{th}$, $9^{th}$, $12^{th}$ and $15^{th}$ subpixels (L2S3, L2S6, L2S9, L2S12 and L2S15) are green subpixels. The upper edges of the first subpixels in the even-number lines of subpixels (L2, L4, L6 and L8) are located at a half length of the first pixels in the odd-number lines of subpixels (L1, L3, L5 and L7) in a line direction. In this way, an isosceles triangle is constructed by centers of any two subpixels adjacent in a column direction (e.g., the first subpixel (L1S1) and the second subpixel (L1S2) in L1) and the center of a subpixel (corresponding to the first subpixel L2S1 in L2) in an adjacent column, the subpixel being closest to the two subpixels and having a color different from those of the two subpixels. Such a pixel arrangement in which the shape constructed by centers of the closest subpixels of different colors is a triangle is called a delta (Δ) pixel array.

Figure 2:
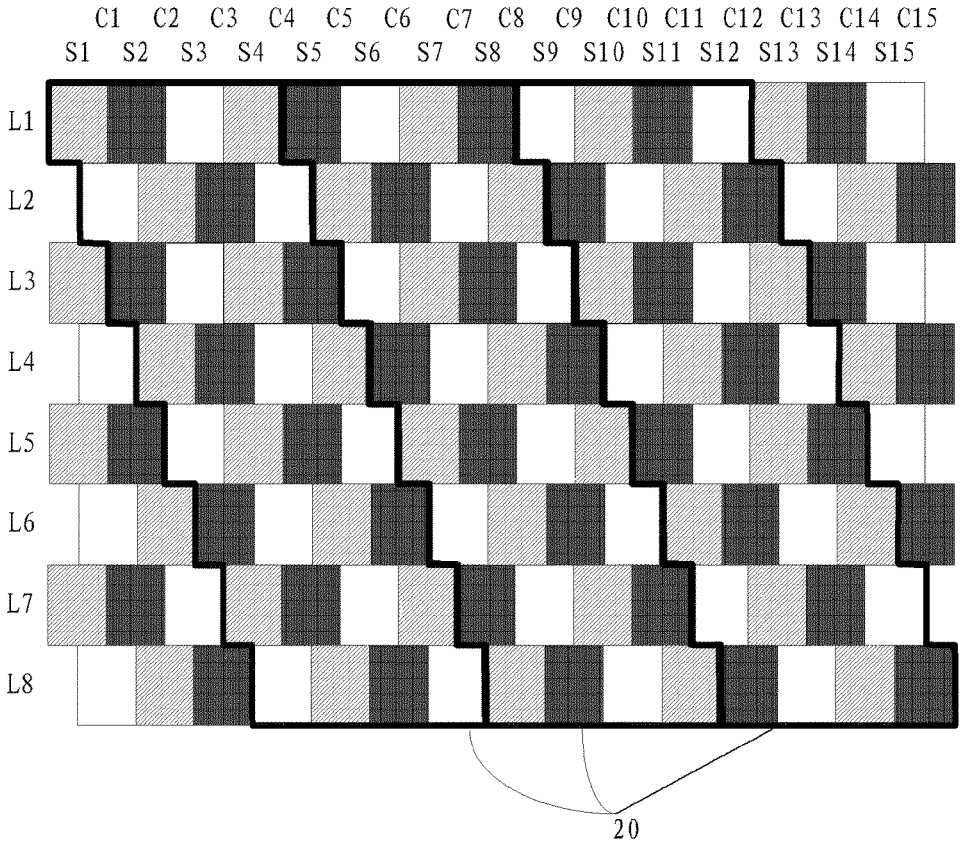
FIG. 2 is a schematic structural view of a pixel unit provided according to an embodiment of the present invention.

Furthermore, as shown in FIG. 2, the pixel array in the above instance is divided into a plurality of pixel units 20. In this case, the width of the pixel units 20 is a lateral width of four subpixels, and the pixel units extend obliquely from the first line in the pixel array to the last line, wherein the oblique degree is a rightward obliqueness of the width of ½ subpixel in a lateral direction per line they extend backwards. Each pixel unit 20 comprises a light blocking region and an opening region, and the grating array in the corresponding pixel unit 20 is also arranged obliquely. The above pixel array and grating array are only one possible implementation according to embodiments of the present invention, to which the present invention shall not be limited.

Figure 3:
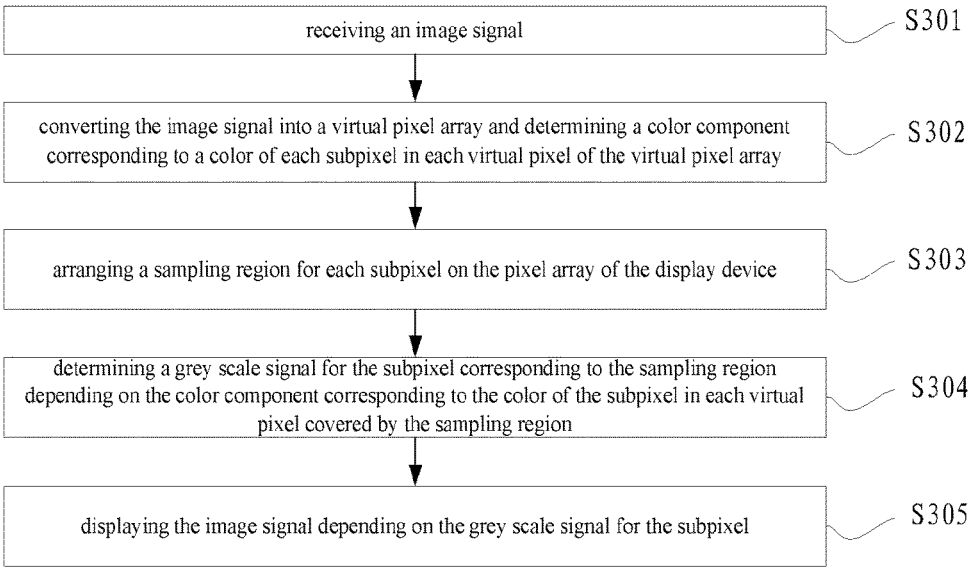
FIG. 3 is a step flowchart of a display driving method provided according to an embodiment of the present invention.

Specifically, as shown in FIG. 3, the display driving method comprises:

S301, receiving an image signal;

S302, converting the image signal into a virtual pixel array and determining a color component corresponding to a color of each subpixel in each virtual pixel of the virtual pixel array;

S303, arranging a sampling region for each subpixel on the pixel array of the display device;

S304, determining a grey scale signal for the subpixel corresponding to the sampling region depending on the color component corresponding to the color of the subpixel in each virtual pixel covered by the sampling region; and S305, displaying the image signal depending on the grey scale signal for the subpixel.

According to the display driving method provided by embodiments of the present invention, upon reception of an image signal, the image signal is first converted into a virtual pixel array and a color component corresponding to a color of each subpixel in each virtual pixel of the virtual pixel array is determined; then a sampling region is arranged for each subpixel on the pixel array of the display device and a grey scale signal for the subpixel corresponding to the sampling region is determined depending on the color component corresponding to the color of the subpixel in each virtual pixel covered by the sampling region; and finally, the image signal is displayed depending on the grey scale signal for the subpixel. Since the grey scale for each subpixel is determined based on the color components of the virtual pixels covered by the sampling region, color components of a plurality of virtual pixels can be displayed with one subpixel in the pixel array according to embodiments of the present invention. That is to say, subpixels in the pixel array can be "shared" to achieve a resolution higher than the actual resolution in visual effects. Therefore, the embodiment of the present invention can improve the display effect of the display device with a given size of the subpixels.

Figure 4:
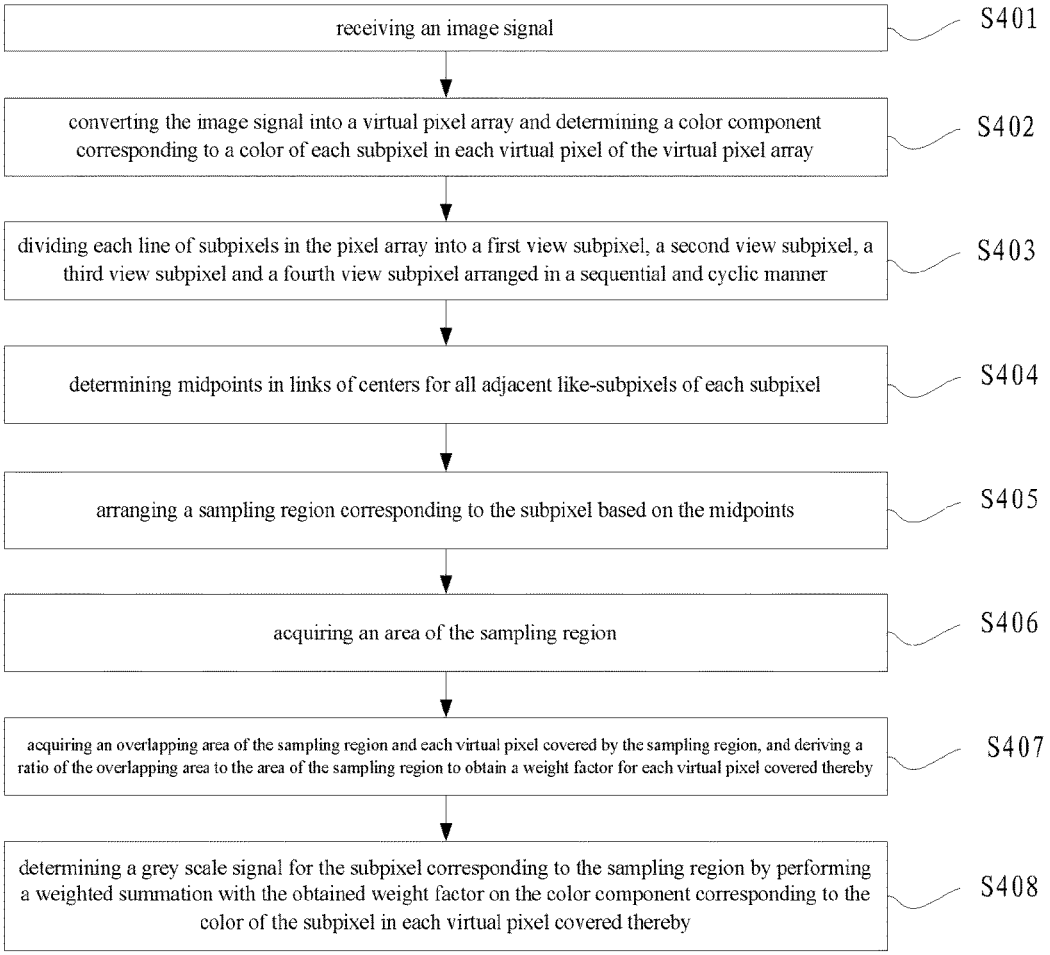
FIG. 4 is a step flowchart of another display driving method provided according to an embodiment of the present invention.

A display driving method is provided according to another embodiment of the present invention, specifically as shown in FIG. 4. The display driving method comprises the following steps.

S401, receiving an image signal.

S402, converting the image signal into a virtual pixel array and determining a color component corresponding to a color of each subpixel in each virtual pixel of the virtual pixel array.

Exemplarily, the virtual pixels in the virtual pixel array are in a shape of square. The side of the square is the same as the height of the subpixel. Each line of the virtual pixel array is aligned with a corresponding line of the pixel array.

Figure 5:
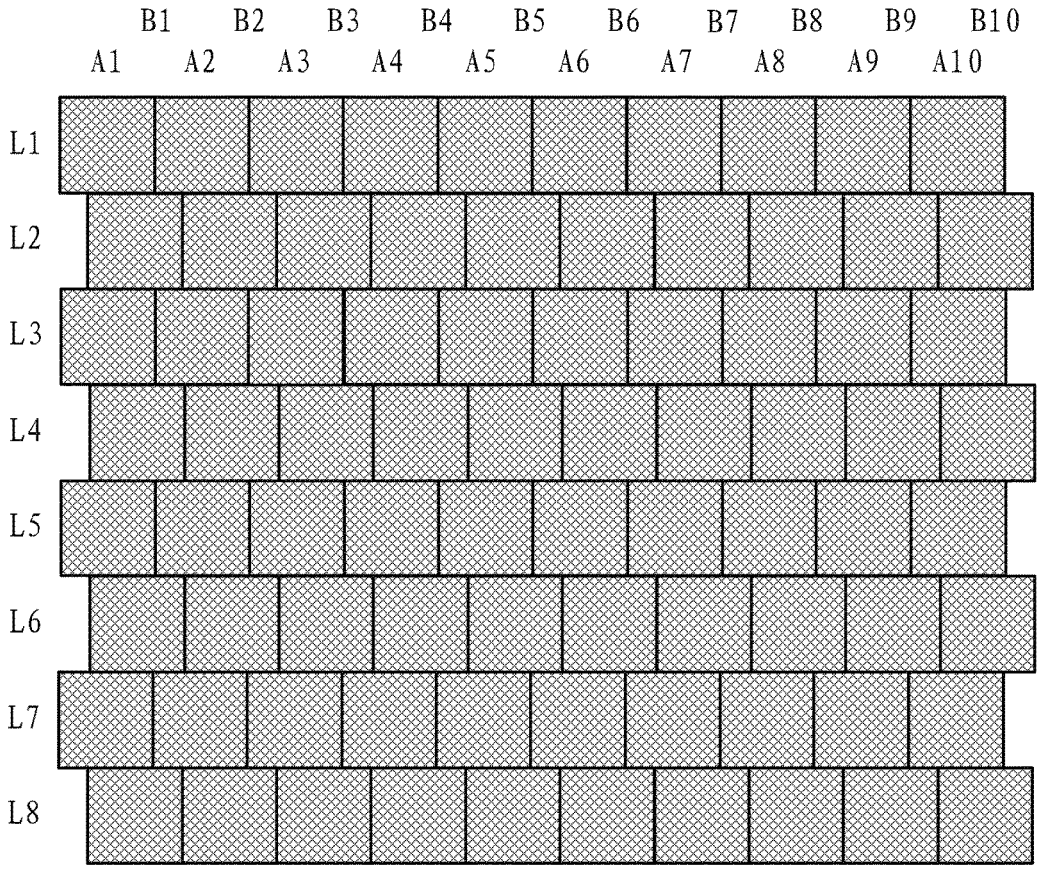
FIG. 5 is a schematic structural view of a virtual pixel array provided according to an embodiment of the present invention.

Specifically, as shown in FIG. 5, the image signal is converted into a virtual pixel array with 8 lines, wherein odd-number lines of virtual pixels are arranged to form 10 columns of subpixels (A1-A10), and even-number lines of virtual pixels are arranged to form 10 columns of subpixels (B1-B10). Besides, the height of the virtual pixels in the virtual pixel array equals the height of the subpixels, and the width of the virtual subpixels equals the height of the virtual subpixels.

Specifically, a color component corresponding to a color of each subpixel in each virtual pixel of the virtual pixel array is determined, i.e., red, green and blue color components in each virtual pixel are determined.

S403, dividing each line of subpixels in the pixel array into a first view subpixel, a second view subpixel, a third view subpixel and a fourth view subpixel arranged in a sequential and cyclic manner, wherein for subpixels in the nth and the (n+1)th lines, when n is divided by 8 and the remainder is 1, the first subpixel in this line is the first view subpixel, when n is divided by 8 and the remainder is 3, the first subpixel in this line is the fourth view subpixel, when n is divided by 8 and the remainder is 5, the first subpixel in this line is the third view subpixel, and when n is divided by 8 and the remainder is 7, the first subpixel in this line is the second view subpixel, and wherein n is an odd-number.

Specifically, as shown in FIG. 6, each line of the pixel array comprises a first view subpixel, a second view subpixel, a third view subpixel and a fourth view subpixel arranged in a sequential and cyclic manner. The first subpixels in the first line (L1) of subpixels and the second line (L2) of subpixels are both first view subpixels. The first subpixels in the third line (L3) of subpixels and the fourth line (L4) of subpixels are both fourth view subpixels. The first subpixels in the fifth line (L5) of subpixels and the sixth line (L6) of subpixels are both third view subpixels. The first subpixels in the seventh line (L7) of subpixels and the eighth line (L8) of subpixels are both second view subpixels.

S404, determining midpoints in links of centers for all adjacent like-subpixels of each subpixel, wherein the adjacent like-subpixels of a subpixel refer to subpixels, which are of the same color and belong to the same view with subpixel, and the pixel lines thereof are adjacent or separated by one line with the pixel line of the subpixel.

Figure 7:
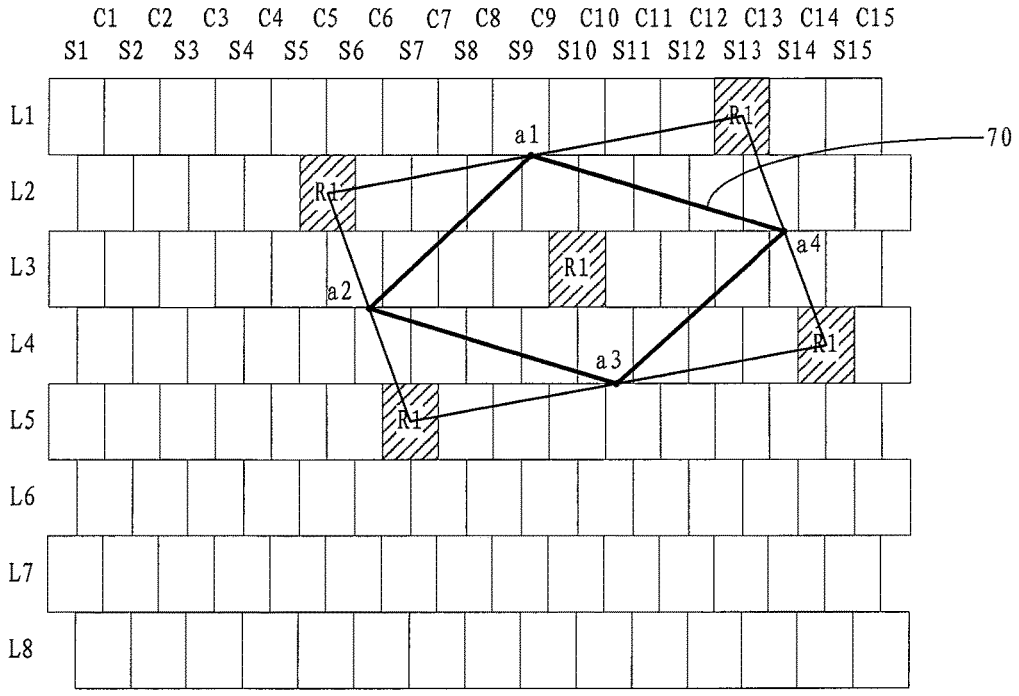
FIG. 7 is a schematic view of midpoints in links for all adjacent like-subpixels of the subpixel L3S10 and a corresponding sampling region provided according to an embodiment of the present invention.

Specifically, as shown in FIG. 7, midpoints in links of centers for all adjacent like-subpixels of a red subpixel (L3S10) for the first view are determined. Subpixels, which are of the same color and adjacent to the red subpixel (L3S10), and the pixel lines thereof are adjacent or separated by one line with the pixel line of the red subpixel (L3S10), include: a subpixel (L1S13), a subpixel (L2C5), a subpixel (L4C14), and a subpixel (L5S7). The midpoint between subpixels (L1S13) and (L2C5) is al, the midpoint between subpixels (L2C5) and (L5S7) is a2,the midpoint between subpixels (L5S7) and (L4C14) is a3, and the midpoint between subpixels (L1S13) and (L4C14) is a4. The method for determining midpoints in links of centers for all adjacent like-subpixels of other red subpixels for the first view is similar to that for determining midpoints in links of centers for all adjacent like-subpixels of the red subpixel (L3S10) in the above embodiment, which will not be described in the text for simplicity.

Figure 8:
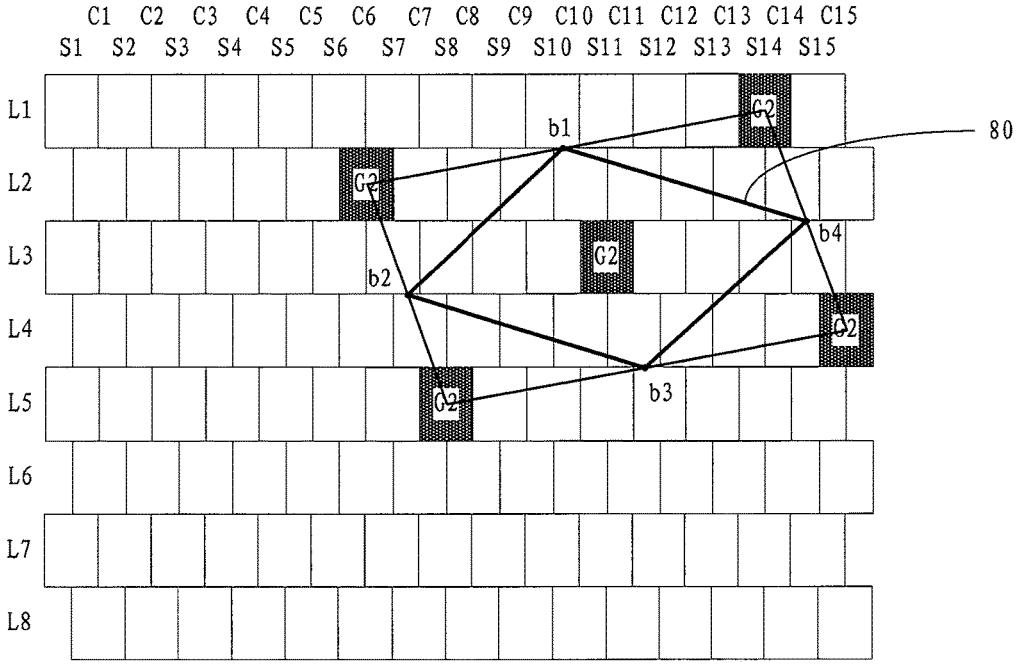
FIG. 8 is a schematic view of midpoints in links for all adjacent like-subpixels of the subpixel L3S11 and a corresponding sampling region provided according to an embodiment of the present invention.
Figure 9:
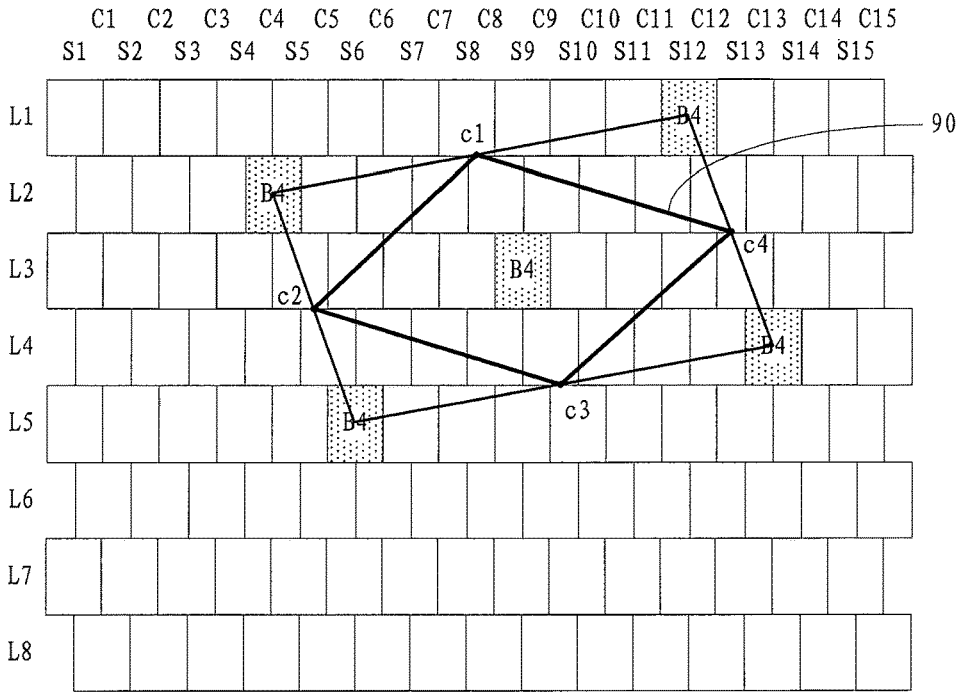
FIG. 9 is a schematic view of midpoints in links for all adjacent like-subpixels of the subpixel L3S9 and a corresponding sampling region provided according to an embodiment of the present invention.

Furthermore, embodiments will be described with reference to FIGS. 8 and 9. As an example, FIG. 8 illustrates determining midpoints in links of centers for all adjacent like-subpixels of a green subpixel (L3S11) for the second view. Subpixels, which are of the same color and adjacent to the green subpixel (L3S11), and the pixel lines thereof are adjacent or separated by one line with the pixel line of the green subpixel (L3S11), include: a subpixel (L1S14), a subpixel (L2C6), a subpixel (L4C15), and a subpixel (L5S8). The midpoint between subpixels (L1S14) and (L2C6) is b1, the midpoint between subpixels (L2C6) and (L5S8) is b2, the midpoint between subpixels (L5S8) and (L4C15) is b3, and the midpoint between subpixels (L1S14) and (L4C15) is b4. As an example, FIG. 9 illustrates determining midpoints in links of centers for all adjacent like-subpixels of a blue subpixel (L3S9) for the fourth view. Subpixels, which are of the same color and adjacent to the blue subpixel (L3S9), and the pixel lines thereof are adjacent or separated by one line with the pixel line of the blue subpixel (L3S9), include: a subpixel (L1S12), a subpixel (L2C4), a subpixel (L4C13), and a subpixel (L5S6). The midpoint between subpixels (L1S12) and (L2C4) is c1, the midpoint between subpixels (L2C4) and (L5S6) is c2, the midpoint between subpixels (L5S6) and (L4C13) is c3, and the midpoint between subpixels (L1S12) and (L4C13) is c4.

S405, arranging a sampling region corresponding to the subpixel based on the midpoints, vertexes of the sampling region falling at the midpoints.

Specifically, as shown in FIG. 7, vertexes of the sampling region fall at the midpoints in links of centers for all adjacent like-subpixels of the subpixel. Thereby, the sampling region for the subpixel (L3S10) is a diamond 70 formed by connecting a1, a2, a3 and a4 sequentially. In a similar way, as shown in FIGS. 8 and 9, the sampling region for the subpixel (L3S11) in FIG. 8 is a diamond 80 formed by connecting b1, b2, b3 and b4 sequentially, and the sampling region for the subpixel (L3S9) in FIG. 9 is a diamond 90 formed by connecting c1, c2, c3 and c4 sequentially.

S406, acquiring an area of the sampling region.

Specifically, for the subpixel (L3S10), the area of the sampling region thereof is namely the area of the diamond 70; for the subpixel (L3S11), the area of the sampling region thereof is namely the area of the diamond 80; and for the subpixel (L3S9), the area of the sampling region thereof is namely the area of the diamond 90, wherein the areas of the sampling regions for individual subpixels being equal.

S407, acquiring an overlapping area of the sampling region and each virtual pixel covered by the sampling region, and deriving a ratio of the overlapping area to the area of the sampling region to obtain a weight factor for each virtual pixel covered thereby.

Figure 10:
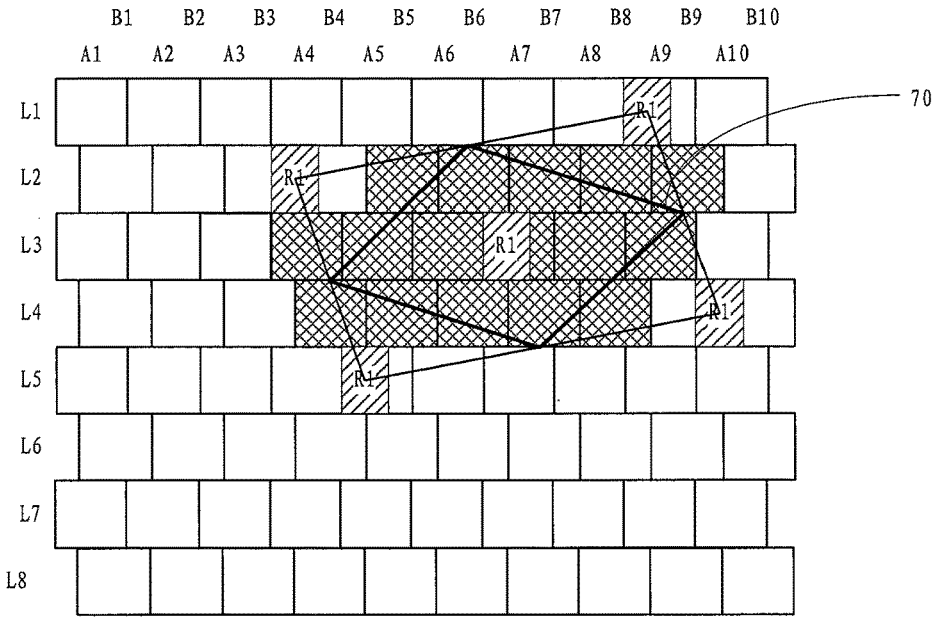
FIG. 10 is a schematic view of an overlapping area of the sampling region for the subpixel L3S10 and the virtual pixels provided according to an embodiment of the present invention.

Specifically, as shown in FIG. 10, there are 16 virtual pixels having an overlapping area with the sampling region 70 for the subpixel (L3S10), namely: L2B5, L2B6, L2B7, L2B8, L2B9, L3A4, L3A5, L3A6, L3A7, L3A8, L3A9, L4B4, L4B5, L4B6, L4B7, and L4B8. The overlapping areas of individual virtual pixels and the sampling region are calculated respectively, and the ratio of each overlapping area to the total area of the sampling region is namely the weight factor for each virtual pixel, the sum of the weight factors for all virtual pixels being 1.

Figure 11:
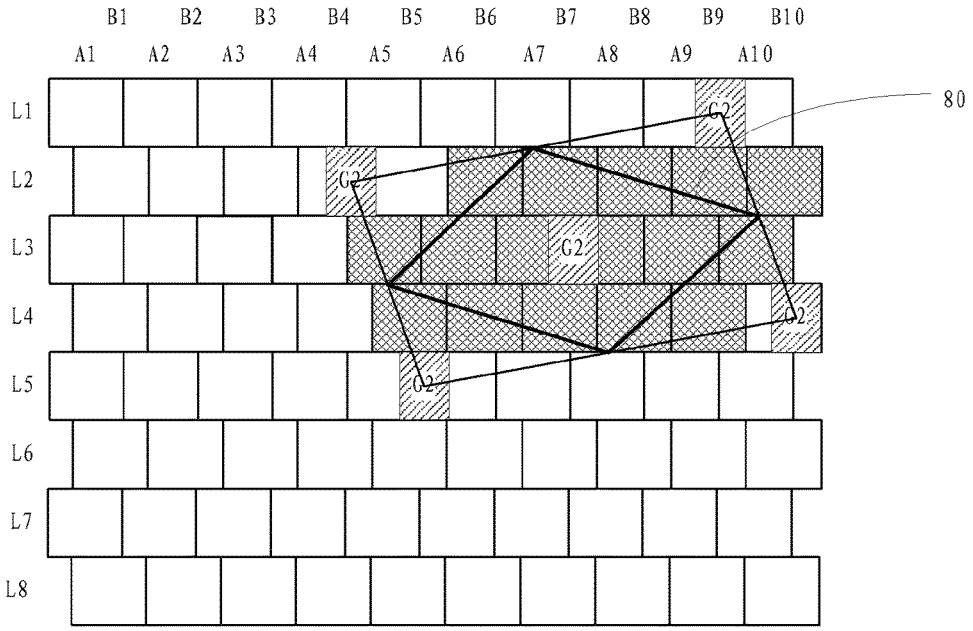
FIG. 11 is a schematic view of an overlapping area of the sampling region for the subpixel L3S11 and the virtual pixels provided according to an embodiment of the present invention.
Figure 12:
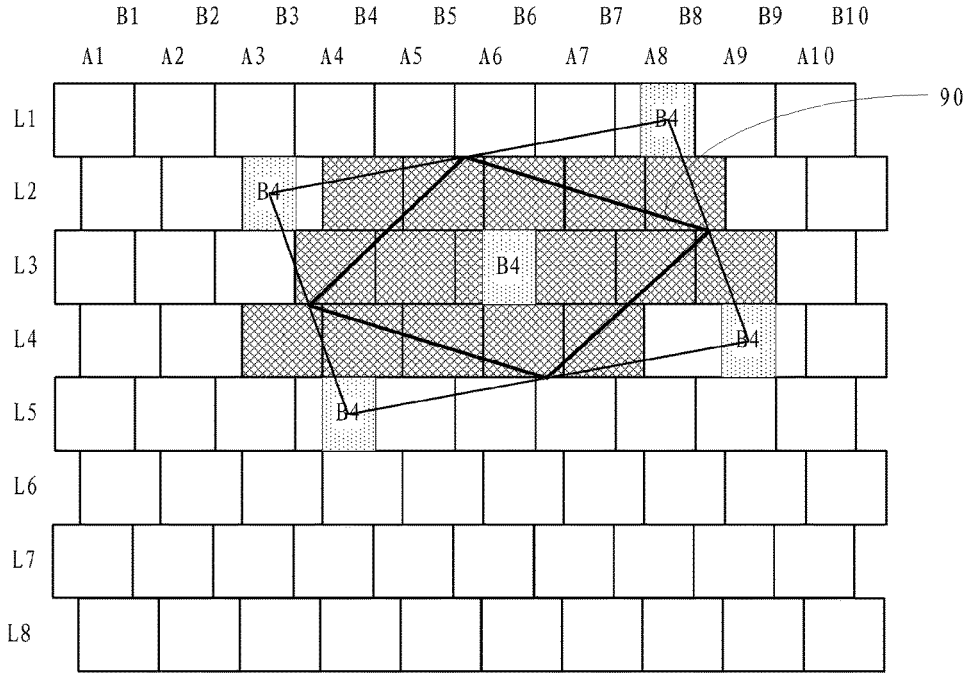
FIG. 12 is a schematic view of an overlapping area of the sampling region for the subpixel L3S9 and the virtual pixels provided according to an embodiment of the present invention.

In a similar way, as shown in FIGS. 11 and 12, there are 16 virtual pixels having an overlapping area with the sampling region 80 for the subpixel (L3S11) in FIG. 11, namely: L2B6, L2B7, L2B8, L2B9, L2B10, L3A5, L3A6, L3A7, L3A8, L3A9, L3A10, L4B5, L4B6, L4B7, L4B8, and L4B10. The overlapping areas of individual virtual pixels and the sampling region are calculated respectively, and the ratio of each overlapping area to the total area of the sampling region is namely the weight factor for each virtual pixel, the sum of the weight factors for individual virtual pixels being 1. There are 16 virtual pixels having an overlapping area with the sampling region 90 for the subpixel (L3S9) in FIG. 12, namely: L2B4, L2B5, L2B86, L2B7, L2B8, L3A4, L3A5, L3A6, L3A7, L3A8, L3A9, L4B3, L4B4, L4B5, L4B6, and L4B7. The overlapping areas of individual virtual pixels and the sampling region are calculated respectively, and the ratio of each overlapping area to the total area of the sampling region is namely the weight factor for each virtual pixel, the sum of the weight factors for individual virtual pixels being 1.

S408, determining a grey scale signal for the subpixel corresponding to the sampling region by performing a weighted summation with the obtained weight factor on the color component corresponding to the color of the subpixel in each virtual pixel covered thereby.

The color component corresponding to the color of the subpixel in each virtual pixel as obtained in step S402 is multiplied by the weight factor for each virtual pixel as obtained in steps S406 and S407, and then the products are added up, the sum being namely the grey scale for the subpixel.

It should be noted that the inventive principle of the present invention is explained by taking determining the grey scale signals for subpixels (L3S10), (L3S11) and (L3S9) as an example. The method for determining the grey scales for other subpixels in the pixel array is similar to that for determining the grey scale signals for subpixels (L3S10), (L3S11) and (L3S9), which will not be described in the present invention for simplicity.

A display driving device is provided according to an embodiment of the present invention. The display driving device can implement the display driving method provided according to the above embodiments. The display driving device is used for driving a 3D display device. The 3D display device comprises a pixel array and a grating array, wherein odd-number lines of the pixel array comprise a subpixel of a first color, a subpixel of a second color and a subpixel of a third color arranged in a sequential and cyclic manner, and even-number lines of the pixel array comprise a subpixel of the third color, a subpixel of the first color and a subpixel of the second color arranged in a sequential and cyclic manner, subpixels in the even-number lines and subpixels in the odd-number lines being offset from each other.

Figure 13:
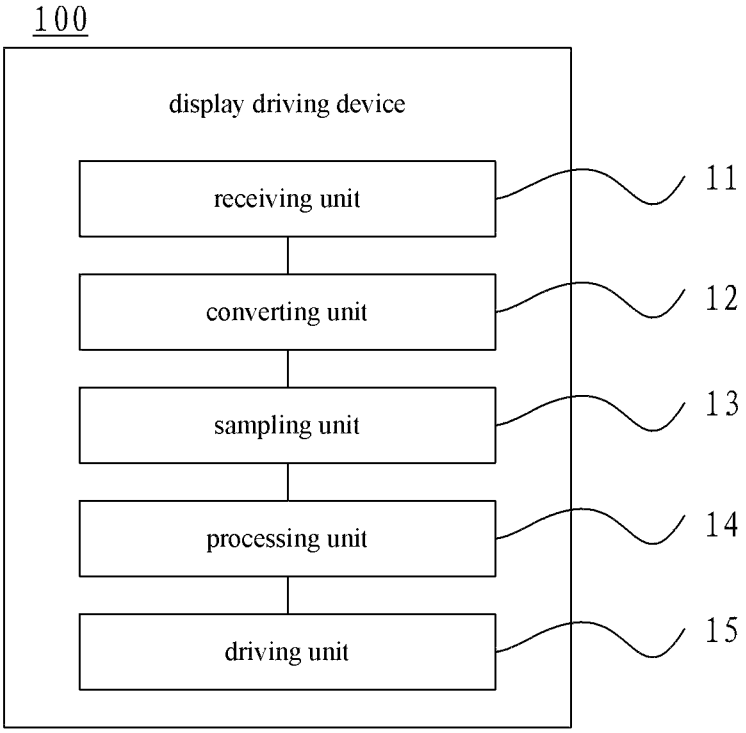
FIG. 13 is a schematic structural view of a display driving device provided according to an embodiment of the present invention.

As shown in FIG. 13, the display driving device 100 comprises:

a receiving unit 11 configured for receiving an image signal;

a converting unit 12 configured for converting the image signal into a virtual pixel array and determining a color component corresponding to a color of each subpixel in each virtual pixel of the virtual pixel array;

a sampling unit 13 configured for arranging a sampling region for each subpixel on the pixel array of the display device;

a processing unit 14 configured for determining a grey scale signal for the subpixel corresponding to the sampling region depending on the color component corresponding to the color of the subpixel in each virtual pixel covered by the sampling region; and a driving unit 15 for displaying the image signal depending on the grey scale signal for the subpixel.

According to the display driving device provided by the embodiment of the present invention, upon reception of an image signal by the receiving unit, the converting unit first converts the image signal into a virtual pixel array and determines a color component corresponding to a color of each subpixel in each virtual pixel of the virtual pixel array; then the sampling unit arranges a sampling region for each subpixel on the pixel array of the display device, and the processing unit determines a grey scale signal for the subpixel corresponding to the sampling region depending on the color component corresponding to the color of the subpixel in each virtual pixel covered by the sampling region; and finally, the driving unit displays the image signal depending on the grey scale signal for the subpixel. Since the grey scale for each subpixel is determined based on the color components of the virtual pixels covered by the sampling region, the color components of a plurality of virtual pixels can be displayed with one subpixel in the pixel array according to the embodiment of the present invention. That is to say, subpixels in the pixel array can be "shared" to achieve a resolution higher than the actual resolution in visual effects. Therefore, the embodiment of the present invention can improve the display effect of the display device with a given size of the subpixels.

Figure 14:
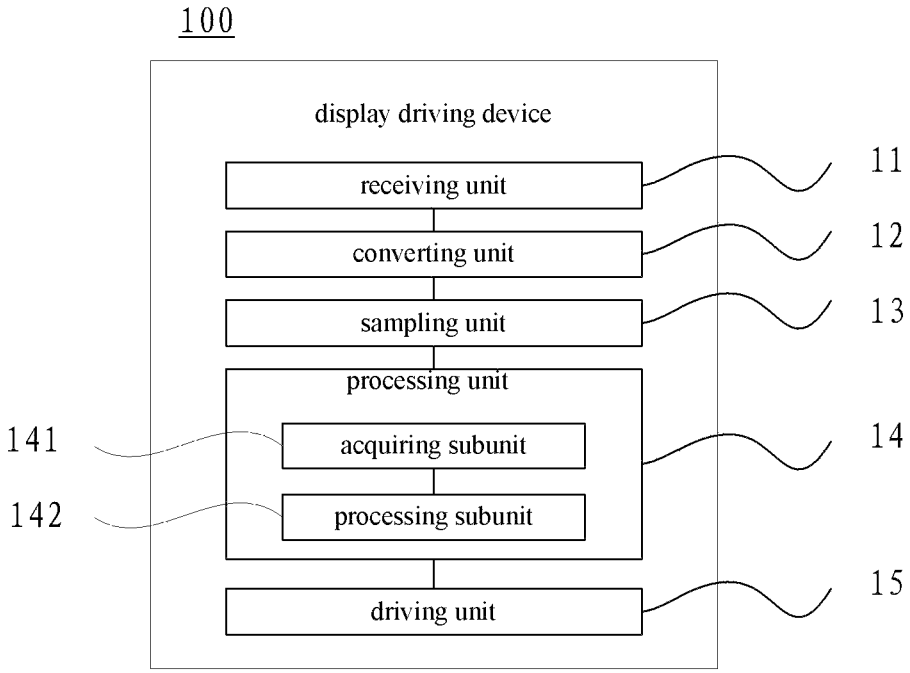
FIG. 14 is a schematic structural view of another display driving device provided according to an embodiment of the present invention.

Specifically, as shown in FIG. 14, the processing unit 14 comprises:

an acquiring subunit 141 configured for acquiring an area of the sampling region, wherein the acquiring subunit 141 is further configured for acquiring an overlapping area of the sampling region and each virtual pixel covered by the sampling region, and deriving a ratio of the overlapping area to the area of the sampling region to obtain a weight factor for each virtual pixel covered thereby; and a processing subunit 142 configured for determining a grey scale signal for the subpixel corresponding to the sampling region by performing a weighted summation with the obtained weighting factor on the color component corresponding to the color of the subpixel in each virtual pixel covered thereby.

Figure 15:
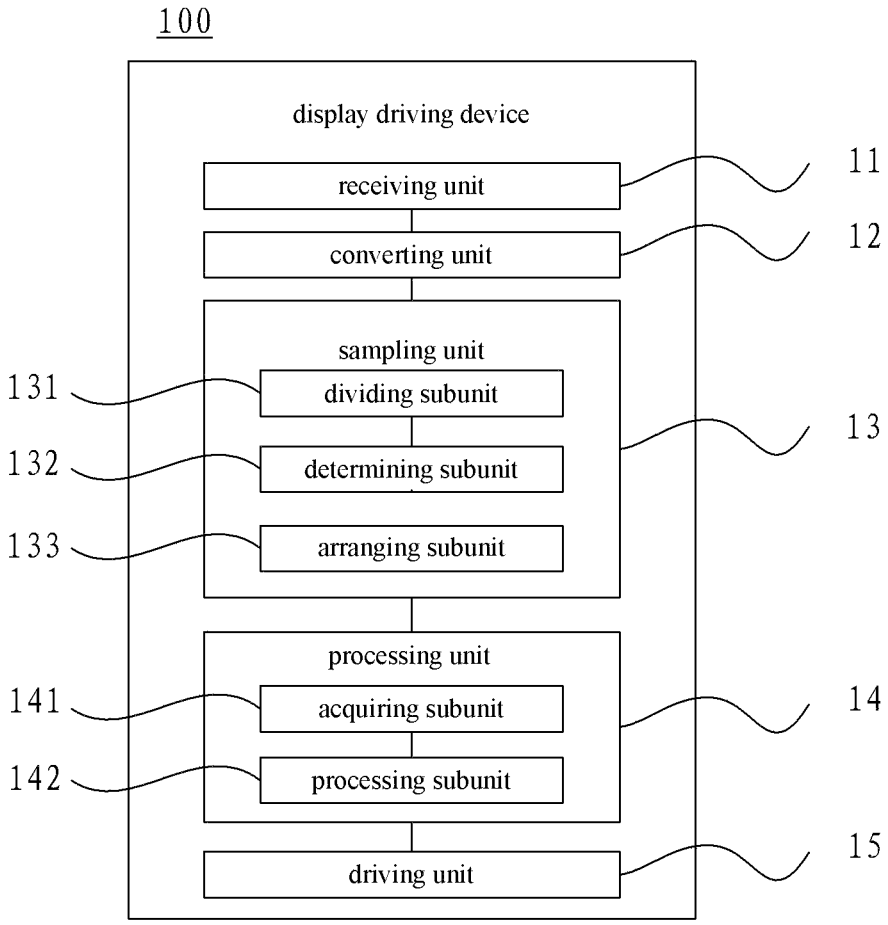
FIG. 15 is a schematic structural view of yet another display driving device provided according to an embodiment of the present invention.

Specifically, as shown in FIG. 15, the sampling unit 13 comprises:

a dividing subunit 131 configured for dividing each line of subpixels in the pixel array into a first view subpixel, a second view subpixel, a third view subpixel and a fourth view subpixel arranged in a sequential and cyclic manner, wherein for subpixels in the nth and the (n+1)th lines, when n is divided by 8 and the remainder is 1, the first subpixel in this line is the first view subpixel, when n is divided by 8 and the remainder is 3, the first subpixel in this line is the fourth view subpixel, when n is divided by 8 and the remainder is 5, the first subpixel in this line is the third view subpixel, and when n is divided by 8 and the remainder is 7, the first subpixel in this line is the second view subpixel, and wherein n is an odd-number;

a determining subunit 132 configured for determining midpoints in links of centers for all adjacent like-subpixels of each subpixel, wherein the adjacent like-subpixels of a subpixel refer to subpixels, which are of the same color and belong to the same view with the subpixel, and the pixel lines thereof are adjacent or separated by one line with the pixel line of the subpixel; and an arranging subunit 133 configured for arranging a sampling region corresponding to the subpixel based on the midpoints, vertexes of the sampling region falling at the midpoints.

Specifically, the virtual pixels in the virtual pixel array are in a shape of square. The side of the square is the same as the height of the subpixel. Each line of the virtual pixel array is aligned with a corresponding line of the pixel array.

Specifically, the first color, the second color and the third color are respectively red, green and blue.

A display device is provided in yet another embodiment of the present invention. The display device comprises a display driving device provided in any of the above embodiments. Besides, the display device can be any product or component having a display function, such as electronic paper, a handset, a tablet computer, a television, a display, a notebook computer, a digital photo frame and a navigator.

According to the display device provided by embodiments of the present invention, upon reception of an image signal by the receiving unit, the converting unit first converts the image signal into a virtual pixel array and determines a color component corresponding to a color of each subpixel in each virtual pixel of the virtual pixel array; then the sampling unit arranges a sampling region for each subpixel on the pixel array of the display device, and the processing unit determines a grey scale signal for the subpixel corresponding to the sampling region depending on the color component corresponding to the color of the subpixel in each virtual pixel covered by the sampling region; and finally, the driving unit displays the image signal depending on the grey scale signal for the subpixel. Since the grey scale for each subpixel is determined based on the color components of the virtual pixels covered by the sampling region, the color components of a plurality of virtual pixels can be displayed with one subpixel in the pixel array according to the embodiment of the present invention. That is to say, subpixels in the pixel array can be "shared" to achieve a resolution higher than the actual resolution in visual effects. Therefore, the embodiment of the present invention can improve the display effect of the display device with a given size of the subpixels.

What is mentioned above is only specific embodiments of the present invention, but the protection scope of the present invention shall not be limited thereto. Any modification or substitution easily conceivable for the skilled person who is familiar with this art within the technical disclosure of the present invention shall fall within the protection scope of the present invention. Therefore, the protection scope of the present invention should be subject to the protection scope of the claims.

The invention claimed is:

1. A display driving method for driving a 3D display device, the 3D display device comprising a pixel array and a grating array, wherein odd-number lines of the pixel array comprise subpixel of a first color, a subpixel of a second color and a subpixel of a third color arranged in a sequential and cyclic manner, and even-number lines of the pixel array comprise a subpixel of the third color, a subpixel of the first color and a subpixel of the second color arranged in a sequential and cyclic manner, subpixels in the even-number lines and subpixels in the odd-number lines being offset from each other, the method comprising steps of:

receiving an image signal;

converting the image signal into a virtual pixel array and determining a color component corresponding to a color of each subpixel in each virtual pixel of the virtual pixel array;

arranging a sampling region for each subpixel on the pixel array of the display device;

determining a grey scale signal for the subpixel corresponding to the sampling region depending on the color component corresponding to the color of the subpixel in each virtual pixel covered by the sampling region; and displaying the image signal depending on the grey scale signal for the subpixel.

2. The method according to claim 1, wherein the step of determining a grey scale signal for the subpixel corresponding to the sampling region depending on the color component corresponding to the color of the subpixel in each virtual pixel covered by the sampling region comprises:

acquiring an area of the sampling region;

acquiring an overlapping area of the sampling region and each virtual pixel covered by the sampling region, and deriving a ratio of the overlapping area to the area of the sampling region to obtain a weight factor for each virtual pixel covered thereby; and determining a grey scale signal for the subpixel corresponding to the sampling region by performing a weighted summation with the obtained weight factor on the color component corresponding to the color of the subpixel in each virtual pixel covered thereby.

3. The method according to claim 1, wherein the step of arranging a sampling region for each subpixel on the pixel array of the display device comprises:

dividing each line of subpixels in the pixel array into a first view subpixel, a second view subpixel, a third view subpixel and a fourth view subpixel arranged in a sequential and cyclic manner, wherein for subpixels in the nth and the (n+1)th lines, when n is divided by 8 and the remainder is 1, the first subpixel in this line is the first view subpixel, when n is divided by 8 and the remainder is 3, the first subpixel in this line is the fourth view subpixel, when n is divided by 8 and the remainder is 5, the first subpixel in this line is the third view subpixel, and when n is divided by 8 and the remainder is 7, the first subpixel in this line is the second view subpixel, and wherein n is an odd-number;

determining midpoints in links of centers for all adjacent like-subpixels of each subpixel, wherein the adjacent like-subpixels of a subpixel refer to subpixels, which are of the same color and belong to the same view with the subpixel, and the pixel lines thereof are adjacent or separated by one line with the pixel line of the subpixel; and arranging a sampling region corresponding to the subpixel based on the midpoints, vertexes of the sampling region falling at the midpoints.

4. The method according to claim 1, wherein the virtual pixels in the virtual pixel array are in a shape of square, the side of the square is the same as the height of the subpixel, and each line of the virtual pixel array is aligned with a corresponding line of the pixel array.

5. The method according to claim 1, wherein the first color, the second color and the third color are respectively red, green and blue.

6. A display driving device for driving a 3D display device, the 3D display device comprising a pixel array and a grating array, wherein odd-number lines of the pixel array comprise a subpixel of a first color, a subpixel of a second color and a subpixel of a third color arranged in a sequential and cyclic manner, and even-number lines of the pixel array comprise a subpixel of the third color, a subpixel of the first color and a subpixel of the second color arranged in a sequential and cyclic manner, subpixels in the even-number lines and subpixels in the odd-number lines being offset from each other, the display driving device comprising:

a receiving unit configured for receiving an image signal;

a converting unit configured for converting the image signal into a virtual pixel array and determining a color component corresponding to a color of each subpixel in each virtual pixel of the virtual pixel array;

a sampling unit configured for arranging a sampling region for each subpixel on the pixel array of the display device;

a processing unit configured for determining a grey scale signal for the subpixel corresponding to the sampling region depending on the color component corresponding to the color of the subpixel in each virtual pixel covered by the sampling region; and a driving unit for displaying the image signal depending on the grey scale signal for the subpixel.

7. The display driving device according to claim 6, wherein the processing unit comprises:

an acquiring subunit configured for acquiring an area of the sampling region, wherein the acquiring subunit is further configured for acquiring an overlapping area of the sampling region and each virtual pixel covered by the sampling region, and deriving a ratio of the overlapping area to the area of the sampling region to obtain a weight factor for each virtual pixel covered thereby; and a processing subunit configured for determining a grey scale signal for the subpixel corresponding to the sampling region by performing a weighted summation with the obtained weight factor on the color component corresponding to the color of the subpixel in each virtual pixel covered thereby.

8. The display driving device according to claim 6, wherein the sampling unit comprises:

a dividing subunit configured for dividing each line of subpixels in the pixel array into a first view subpixel, a second view subpixel, a third view subpixel and a fourth view subpixel arranged in a sequential and cyclic manner, wherein for subpixels in the nth and the (n+1)th lines, when n is divided by 8 and the remainder is 1, the first subpixel in this line is the first view subpixel, when n is divided by 8 and the remainder is 3, the first subpixel in this line is the fourth view subpixel, when n is divided by 8 and the remainder is 5, the first subpixel in this line is the third view subpixel, and when n is divided by 8 and the remainder is 7, the first subpixel in this line is the second view subpixel, and wherein n is an odd-number;

a determining subunit configured for determining midpoints in links of centers for all adjacent like-subpixels of each subpixel, wherein the adjacent like-subpixels of a subpixel refer to subpixels, which are of the same color and belong to the same view with the subpixel, and the pixel lines thereof are adjacent or separated by one line with the pixel line of the subpixel; and an arranging subunit configured for arranging a sampling region corresponding to the subpixel based on the midpoints, vertexes of the sampling region falling at the midpoints.

9. The display driving device according to claim 6, wherein the virtual pixels in the virtual pixel array are in a shape of square, the side of the square is the same as the height of the subpixel, and each line of the virtual pixel array is aligned with a corresponding line of the pixel array.

10. The display driving device according to claim 6, wherein the first color, the second color and the third color are respectively red, green and blue.

11. A display device, wherein the display device comprises the display driving device according to claim 6.

12. The display device according to claim 11, wherein the processing unit comprises:

an acquiring subunit configured for acquiring an area of the sampling region, wherein the acquiring subunit is further configured for acquiring an overlapping area of the sampling region and each virtual pixel covered by the sampling region, and deriving a ratio of the overlapping area to the area of the sampling region to obtain a weight factor for each virtual pixel covered thereby; and a processing subunit configured for determining a grey scale signal for the subpixel corresponding to the sampling region by performing a weighted summation with the obtained weight factor on the color component corresponding to the color of the subpixel in each virtual pixel covered thereby.

13. The display device according to claim 11, wherein the sampling unit comprises:

a dividing subunit configured for dividing each line of subpixels in the pixel array into a first view subpixel, a second view subpixel, a third view subpixel and a fourth view subpixel arranged in a sequential and cyclic manner, wherein for subpixels in the nth and the (n+1)th lines, when n is divided by 8 and the remainder is 1, the first subpixel in this line is the first view subpixel, when n is divided by 8 and the remainder is 3, the first subpixel in this line is the fourth view subpixel, when n is divided by 8 and the remainder is 5, the first subpixel in this line is the third view subpixel, and when n is divided by 8 and the remainder is 7, the first subpixel in this line is the second view subpixel, and wherein n is an odd-number;

a determining subunit configured for determining midpoints in links of centers for all adjacent like-subpixels of each subpixel, wherein the adjacent like-subpixels of a subpixel refer to subpixels, which are of the same color and belong to the same view with the subpixel, and the pixel lines thereof are adjacent or separated by one line with the pixel line of the subpixel; and an arranging subunit configured for arranging a sampling region corresponding to the subpixel based on the midpoints, vertexes of the sampling region falling at the midpoints.

14. The display device according to claim 11, wherein the virtual pixels in the virtual pixel array are in a shape of square, the side of the square is the same as the height of the subpixel, and each line of the virtual pixel array is aligned with a corresponding line of the pixel array.

15. The display device according to claim 11, wherein the first color, the second color and the third color are respectively red, green and blue.

* * * * *